US008375501B1

(12) United States Patent
Courcy

(10) Patent No.: US 8,375,501 B1
(45) Date of Patent: Feb. 19, 2013

(54) SHOE-ATTACHED BRUSH SYSTEM FOR CLEANING GOLF CLUBS

(76) Inventor: Timothy Courcy, Plano, TX (US)

( * ) Notice: Subject to any disclaimer, the term of this patent is extended or adjusted under 35 U.S.C. 154(b) by 0 days.

(21) Appl. No.: 13/297,545

(22) Filed: Nov. 16, 2011

(51) Int. Cl.
*A46B 15/00* (2006.01)

(52) U.S. Cl. ..... 15/160; 15/210.1; 15/227

(58) Field of Classification Search ..... 15/160, 15/210.1, 227
See application file for complete search history.

(56) References Cited

U.S. PATENT DOCUMENTS

| | | | | |
|---|---|---|---|---|
| 4,122,577 | A | 10/1978 | Catania | |
| 5,930,920 | A | 8/1999 | Arnold | |
| 5,979,008 | A | 11/1999 | Gordon | |
| 6,393,648 | B1 * | 5/2002 | Reynolds | 15/160 |
| 6,536,139 | B2 | 3/2003 | Darley et al. | |
| 6,732,397 | B2 | 5/2004 | Thompson | |
| 7,559,127 | B2 | 7/2009 | Rooney et al. | |
| 2003/0000053 | A1 * | 1/2003 | Rooney et al. | 24/712.6 |
| 2003/0131500 | A1 | 7/2003 | Kline et al. | |

* cited by examiner

*Primary Examiner* — Monica Carter
*Assistant Examiner* — Stephanie N Berry

(57) ABSTRACT

A brush system for attaching to a shoe having a base with a top surface, a bottom surface, and a side edge, a plurality of bristles extending upwardly from the top surface, a clip divided into an arced portion and a flat portion, the arced portion extends outwardly from the side edge of the base and curves around underneath the bottom surface of the base and the flat portion is positioned below and parallel to the bottom surface of the base, a gap exists between the clip and the bottom surface, the arced portion of the clip has a middle bar and a first and a second side bar, a gap exists both between the first side bar, the middle bar, and the second side bar, and a slit in the first side bar and the second side bar of the arced portion.

4 Claims, 3 Drawing Sheets

TOP VIEW

SIDE VIEW

BACK VIEW

SHOE-ATTACHED BRUSH SYSTEM FOR CLEANING GOLF CLUBS

FIELD OF THE INVENTION

The present invention is directed to a brush system, more particularly to a brush system attachable to a user's shoelaces, more particularly to a brush system for cleaning faces of golf clubs.

BACKGROUND OF THE INVENTION

Many golfers prefer to brush clean the face of the golf club about to be used, as clean clubs can allow for better and more accurate shots. Many brushes are attached to the golfer's golf bag or are kept in the golfer's pocket. The present invention features a novel brush system attached to a golfer's shoes for cleaning golf clubs. The system of the present invention eliminates the need for the golfer to leave his stance, which can save time and help with muscle memory.

SUMMARY

The present invention features a shoe-attached brush system for cleaning golf clubs. In some embodiments, the brush system comprises a base having a top surface, a bottom surface, and a side edge; a plurality of bristles extending upwardly from the top surface of the base; a clip divided into an arced portion and a flat portion, the arced portion extends outwardly from the side edge of the base and curves around underneath the bottom surface of the base and the flat portion is positioned below and parallel to the bottom surface of the base, a gap exists between the clip and the bottom surface of the base, the arced portion of the clip comprises a middle bar and a first side bar positioned on a first side of the middle bar and a second side bar positioned on a second side of the middle bar, a gap exists both between the first side bar and the middle bar and between the second side bar and the middle bar; and a first slit disposed in the first side bar of the arced portion and a second slit disposed in the second side bar of the arced portion, the first slit and the second slit are both oriented perpendicularly to a height of the base, the height being measured from the bottom surface to the top surface of the base.

In some embodiments, the side edge of the base is rounded. In some embodiments, the system further comprises a portion of a shoe sandwiched between the bottom surface of the base and the flat portion of the clip.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
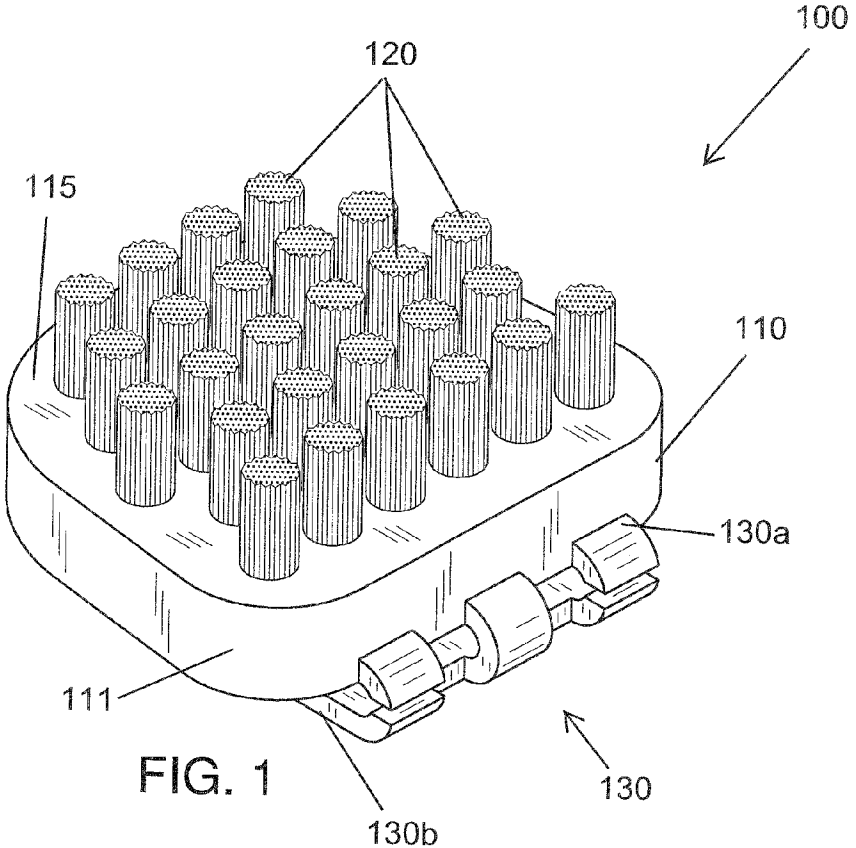
FIG. 1 is a perspective view of the system of the present invention.

Referring now to FIGS. 1-5, the present invention features a brush system 100 for cleaning golf clubs. The system 100 comprises a base 110 having a top surface 115, a bottom surface 116, and, a side edge 111. Disposed on the top surface 115 (and extending upwardly from the top surface 115) is a plurality of bristles 120. In some embodiments, the bristles 120 are constructed from a material comprising plastic, however the bristles 120 are not limited to this material.

Figure 2:
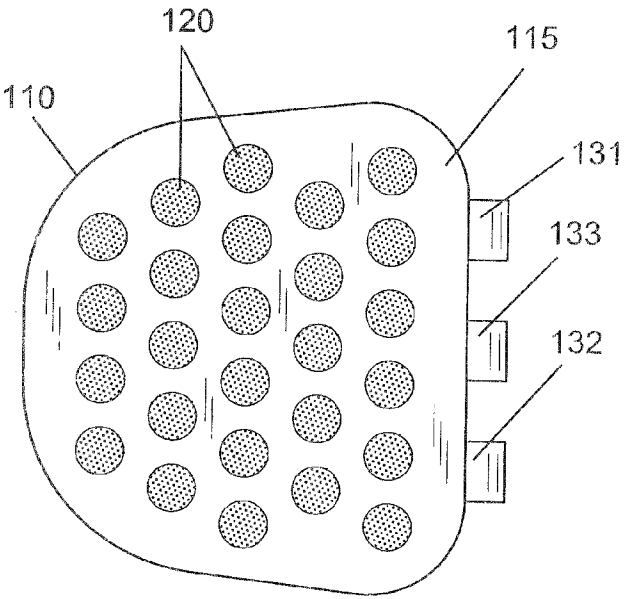
FIG. 2 is a top view of the system of the present invention.
Figure 3:
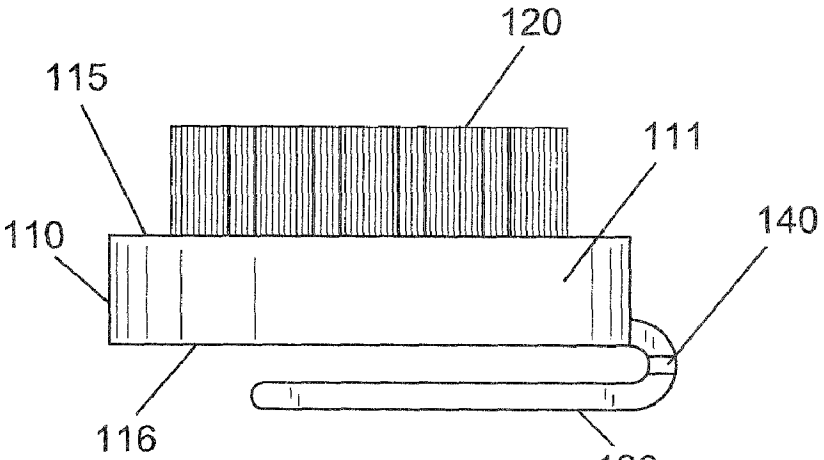
FIG. 3 is a side view of the system of the present invention.

The base 110 may be constructed in a variety of shapes. For example, as shown in FIG. 1 and FIG. 2, in some embodiments, the base 110 has rounded edges (e.g., the side edge 111 is rounded).

Figure 5:
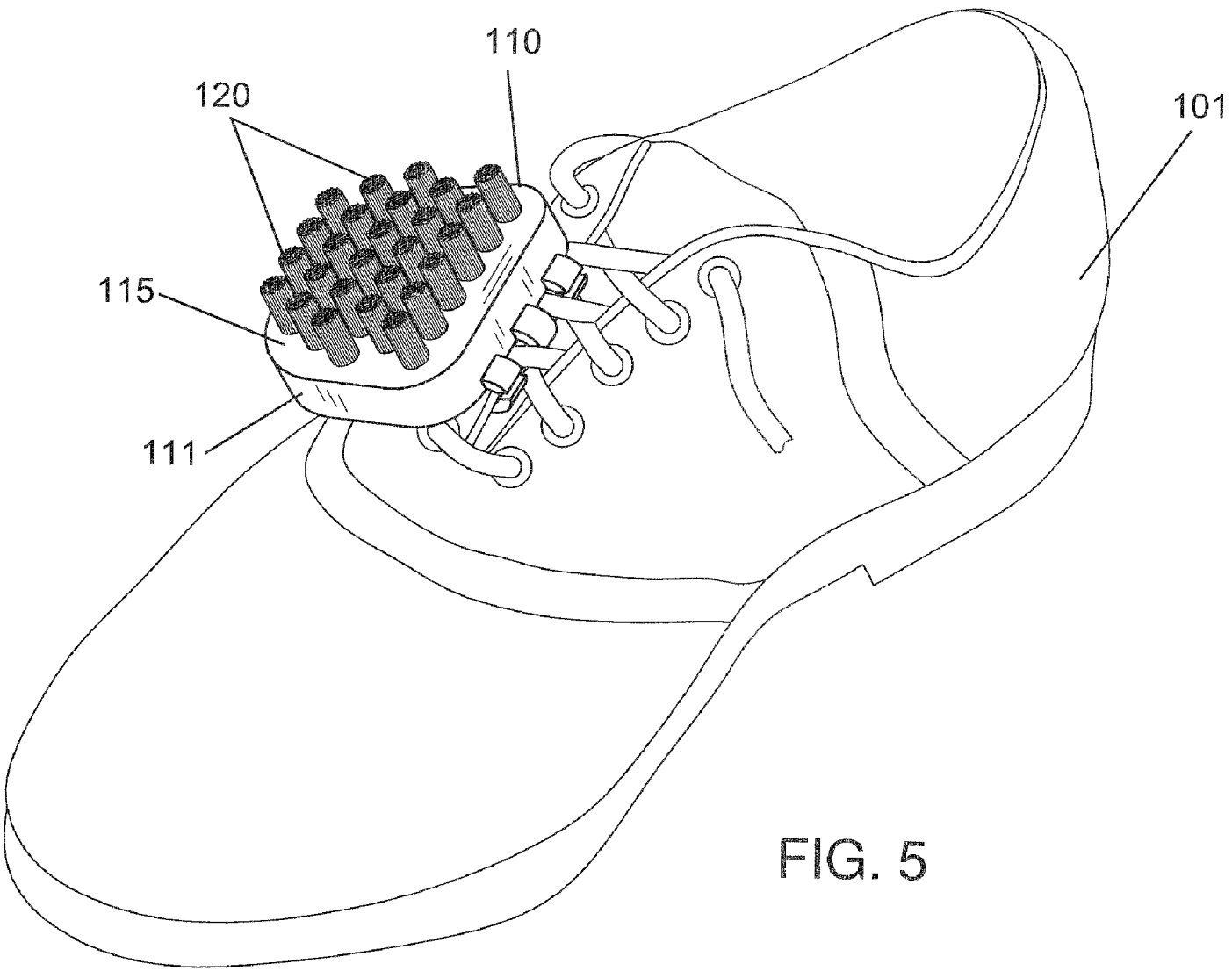
FIG. 5 is an in-use view of the system of the present invention.

The system 100 further comprises a clip 130 for enabling the base 110 to be attached to a shoe 101 (e.g., as shown in FIG. 5). The clip 130 extends from the side edge 111 of the base 110 and curves around and underneath the bottom surface 116 of the base 110. A gap exists between the clip 130 and the bottom surface 116 of the base 110 (e.g., see FIG. 3). The clip 130 is divided into an arced portion 130*a* (which extends from the side edge 111 of the bale 110 and around under the bottom surface 116 of the base 110) and a flat portion 130*b* (which is below the bottom surface 116 of the base 110).

Figure 4:
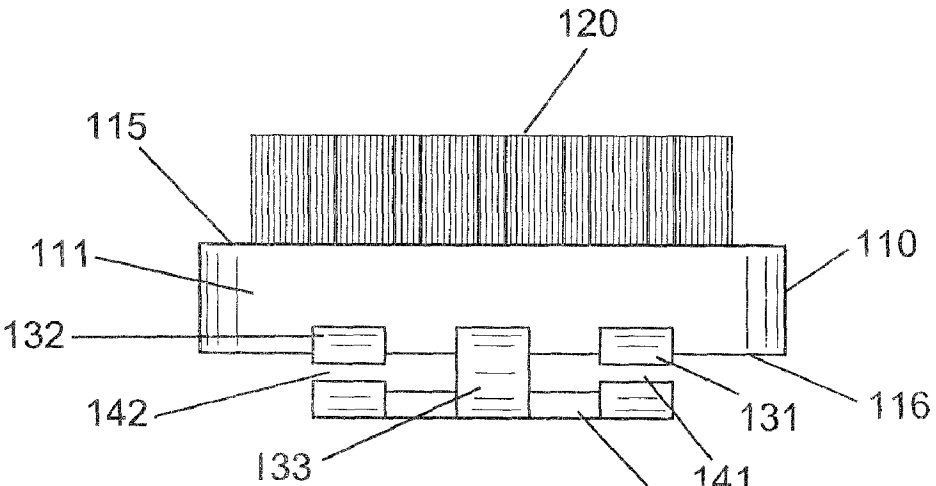
FIG. 4 is a back view of the system of the present invention.

As shown in FIG. 4, the arced portion 130*a* of the clip 130 comprises a middle bar 133 and at least a first side bar 131 positioned on a first side of the middle bar 133 and a second side bar 132 positioned on a second side of the middle bar 133. A gap exists between the first side bar 131 and the middle bar 133 and between the second side bar 132 and the middle bar 133.

A first slit 141 is disposed in the first side bar 131 of the arced portion 130*a* as shown in FIG. 4. A second slit 142 is disposed in the second side bar 132 of the arced portion 130*a* as shown in FIG. 4. The first slit 141 and the second slit 142 are both oriented perpendicularly to the height of the base 110, the height being measured from the bottom surface 116 to the top surface 115 of the base 110.

The slits 140 allow the user's shoelaces to pass through and further in between either the first side bar 131 and the middle bar 133 or the second side bar 132 and the middle bar 133. The clip 130 engages (e.g., snugly sandwiches) the portion of the shoe with the shoelace eyelets as shown in FIG. 5.

The disclosures of the following U.S. Patents are incorporated in their entirety by reference herein: U.S. Pat. No. 4,122,577; U.S. Pat. No. 5,930,920; U.S. Pat. No. 5,979,008; U.S. Pat. No. 6,393,648; U.S. Pat. No. 6,536,139; U.S. Pat. No. 6,732,397; U.S. Pat. No. 7,559,127; U.S. Patent Application No. 2003/0131500.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A brush system 100 for attaching to a shoe 101, said brush system 100 comprising:

(a) a base 110 having a top surface 115, a bottom surface 116, and a side edge 111;

(b) a plurality of bristles extending upwardly from the top surface 115 of the base 110;

(c) a clip 130 divided into an arced portion 130*a* and a flat portion 130*b*, the arced portion 130*a* extends outwardly from the side edge 111 of the base and curves around underneath the bottom surface 116 of the base 110 and the flat portion 130 is positioned below and parallel to the bottom surface 116 of the base 110, a gap exists between the clip 130 and the bottom surface 116 of the base 110, the arced portion 130*a* of the clip 130 comprises a middle bar 133 and a first side bar 131 positioned on a first side of the middle bar 133 and a second side bar 132 positioned on a second side of the middle bar 133, a gap exists both between the first side bar 131 and the middle bar 133 and between the second side bar 132 and the middle bar 133; and (d) a first slit 141 disposed in the first side bar 131 of the arced portion 130*a* and a second slit 142 disposed in the second side bar 132 of the arced portion 130*a*, the first slit 141 and the second slit 142 are both oriented perpendicularly to a height of the base 110, the height being measured from the bottom surface 116 to the top surface 115 of the base 110; wherein the slits 141 and 142 allow the user's shoelaces to pass through and further in between either the first side bar 131 and the middle bar 133 or the second side bar 132 and the middle bar 133.

2. The brush system 100 of claim 1, wherein the side edge 111 of the base 110 is rounded.

3. The system 100 of claim 1 further comprising a portion of a shoe sandwiched between the bottom surface 116 of the base 110 and the flat portion 130*b* of the clip 130.

4. A brush system 100 for attaching to a shoe 101, said brush system 100 consisting of:

(a) a base 110 having a top surface 115, a bottom surface 116, and a side edge 111;

(b) a plurality of bristles extending upwardly from the top surface 115 of the base 110;

(c) a clip 130 divided into an arced portion 130*a* and a flat portion 130*b*, the arced portion 130*a* extends outwardly from the side edge 111 of the base and curves around underneath the bottom surface 116 of the base 110 and the flat portion 130 is positioned below and parallel to the bottom surface 116 of the base 110, a gap exists between the clip 130 and the bottom surface 116 of the base 110, the arced portion 130*a* of the clip 130 corn wises a middle bar 133 and a first side bar 131 positioned on a first side of the middle bar 133 and a second side bar 132 positioned on a second side of the middle bar 133, a gap exists both between the first side bar 131 and the middle bar 133 and between the second side bar 132 and the middle bar 133; and (d) a first slit 141 disposed in the first side bar 131 of the arced portion 130*a* and a second slit 142 disposed in the second side bar 132 of the arced portion 130*a*, the first slit 141 and the second slit 142 are both oriented perpendicularly to a height of the base 110, the height being measured from the bottom surface 116 to the top surface 115 of the base 110; wherein the slits 141 and 142 allow the user's shoelaces to pass through and further in between either the first side bar 131 and the middle bar 133 or the second side bar 132 and the middle bar 133.

* * * * *